US011765493B2

(12) United States Patent
Hui et al.

(10) Patent No.: US 11,765,493 B2
(45) Date of Patent: Sep. 19, 2023

(54) HELMET WITH AUDIO SAFETY EAR CUP

(71) Applicant: BITwave Pte Ltd, Singapore (SG)

(72) Inventors: Siew Kok Hui, Singapore (SG); Ng Jiefeng Bryan, Singapore (SG)

(73) Assignee: BITWAVE PTE LTD., Singapore (SG)

( * ) Notice: Subject to any disclaimer, the term of this patent is extended or adjusted under 35 U.S.C. 154(b) by 83 days.

(21) Appl. No.: 17/546,476

(22) Filed: Dec. 9, 2021

(65) Prior Publication Data

US 2022/0191603 A1 Jun. 16, 2022

Related U.S. Application Data

(60) Provisional application No. 63/124,545, filed on Dec. 11, 2020.

(51) Int. Cl.
*H04R 1/02* (2006.01)
*H04R 1/10* (2006.01)

(52) U.S. Cl.
CPC ..... *H04R 1/028* (2013.01); *H04R 1/1083* (2013.01)

(58) Field of Classification Search
CPC ..... H04R 1/028; H04R 1/1083; H04R 1/025; H04R 1/342; H04R 2201/023; H04R 2460/01; G10K 11/002; G10K 11/004
USPC ..... 381/344
See application file for complete search history.

(56) References Cited

U.S. PATENT DOCUMENTS 5,914,661 A * 6/1999 Gross ..... G01S 7/495 356/141.5
2017/0150769 A1* 6/2017 Lebel ..... H04R 1/1066
2018/0139539 A1* 5/2018 Zimmer ..... H04R 1/1008
2021/0137072 A1* 5/2021 Beck ..... A61F 11/14

* cited by examiner

*Primary Examiner* — Carolyn R Edwards
*Assistant Examiner* — Friedrich Fahnert
(74) *Attorney, Agent, or Firm* — Amin, Turocy & Watson, LLP

(57) ABSTRACT

A protective headgear including an on-ear headset attachable to an inside portion of the protective headgear; a magnetization exhibited that reduces a gap between the compressible foam material of the protective headgear and the on-ear headset; and a method of adjusting the force of the magnetization by a switch adapted to the outer casing of the protective head gear, wherein the switch adjusts the distance between the protective headgear magnet and the on-ear headset magnet.

20 Claims, 10 Drawing Sheets

HELMET WITH AUDIO SAFETY EAR CUP

RELATED APPLICATION

The subject patent application claims priority to U.S. Provisional Patent Appln. No. 63/124,545, filed Dec. 11, 2020, entitled "A Safety Audio Ear Cup for Helmet Application". The entirety of the aforementioned application is hereby incorporated by reference herein.

TECHNICAL FIELD

The subject application is in the field of safety audio helmets which relate to protective headgear embedded with a headset communication device with echo cancellation, interference sound cancellation, and extreme wind noise and environmental noise resistance, while having overall noise cancellation capabilities, pertaining particularly to methods and apparatus that facilitate such speech communication in hostile noisy environments.

BACKGROUND

The protective headgear receives noise cancelling headphones into a recess and earcup to reduce a gap between the user's head and the protective headgear. By reducing the gap, the headphones will significantly cut down on the surrounding noises from various sources e.g. siren sounds from an emergency vehicle. By providing a tight ear-cup surrounding the ear, a quiet space is created over the ear-canal.

High level noise exposure is the most common factor associated with permanent hearing loss of individuals. Prolonged and excessive noise levels may cause either temporary or more severely permanent hearing threshold shift. This leads to the loss of hearing sensitivity. It is difficult to predict the level and duration of exposure required to cause damage. Noise damage becomes increasingly likely as the sound levels rise significantly above 90 dB for a pro-long period. As sound levels increase, the safe time of exposure decreases.

A motorcyclist's ability to hear while riding is a critical safety factor in the modern environment. Unfortunately, a motorcyclist's hearing may be impeded by engine noise, wind noise and helmet design, among other things. High noise levels, such as those experienced by motorcyclists, may increase fatigue, may impair reaction times and may impede attention, effectively reducing the safety of the motorcyclists and those around him or her.

There are approximately 13 million full motorcycle licence holders in the US, and at least 1.3 million of these ride occupationally. There is now unequivocal evidence that motorcyclists are regularly exposed to noise levels in excess of 90 dB when they ride. At 50 mph, a motorcyclist suffers approximately 90 dB of low frequency wind noise caused by turbulent airflow around the helmet. Wind noise continues to increase linearly with speed and can hit levels of around 110 dB at 100 mph. At this level of noise, it is only safe for less than 5 minutes per day. Therefore, hearing protection is needed. Currently the only realistic option is earplugs. It has been recently demonstrated that wearing of ear protection does not compromise a rider's ability to detect warning signals and may actually offer hearing advantages at higher speeds due to reduced noise masking of warning signals.

To combat the damaging noise, some motorcycle helmets use sound deadening material around the area of the ears. Other motorcyclists may choose to use earplugs to reduce noise and prevent noise induced hearing loss. In both cases, the motorcyclist's hearing may be protected, but it is also impaired such that the motorcyclist may not be able to hear other cars, people, sirens, etc. around him or her.

Microphones used for active noise control and voice input can also form an array. This will enable the user that used the headphone to be able to hear their surrounding acoustic scene with sound directional information. This arrangement will allow the user to continuously be aware of his/her surrounding acoustic scene, Gaussian Mixture Models are used for both signal classification and pre-trained for sound source direction information both with the headphone installed into the helmet or not.

SUMMARY

The following presents a simplified summary of the specification in order to provide a basic understanding of some aspects of the specification. This summary is not an extensive overview of the specification. It is intended to neither identify key or critical elements of the specification nor delineate the scope of any particular embodiments of the specification, or any scope of the claims. Its sole purpose is to present some concepts of the specification in a simplified form as a prelude to the more detailed description that is presented in this disclosure.

The present application provides various embodiments for a wearable array using protective headgear configured to receive a headset, noise cancelling headphones, a microphone array, and a trained Gaussian Mixture model for sound directional identification. The wearable array will enable the device to be used in extremely windy and hostile noisy conditions such as riding a bike, snowmobile, ATV or even skydiving.

An example embodiment of the present application provides An apparatus integral with, or attachable to, a protective headgear, comprising a cushioned bendable material integral with, or attachable to, an inside portion of the protective headgear, wherein an ear cup of the inside portion of the protective headgear is able to expand and contract; an on-ear headset attachable to an inside portion of the protective headgear; a first magnet within the ear cup of the inside portion of the protective headgear that attaches the on-ear headset to the ear cup; a second magnet that exerts a force, on the cushioned bendable material, towards an outer casing of the protective headgear to create a recess for the on-ear headset; a battery receiving portion to position a battery in the ear cup; and a switch to change the polarity of the second magnet.

Another example embodiment of an apparatus integral with, or attachable to, a protective headgear, wherein the cushioned bendable material of the ear cup comprises memory foam for sound isolation.

Another example embodiment of an apparatus integral with, or attachable to, a protective headgear, further comprising a microphone integral with, or attachable to, the protective headgear, wherein the microphone captures sound directional input and voice input from sound input received via the microphone.

Another example embodiment of an apparatus integral with, or attachable to, a protective headgear, wherein the cushioned bendable material of the ear cup comprises at least a portion that is dense paper of at least a threshold density.

Another example embodiment of an apparatus integral with, or attachable to, a protective headgear, wherein the on-ear headset is coupled to a dynamic range controller that enables setting of at least one of an upper sound level limit or a lower sound level limit for sound output to a user via the on-ear headset, and wherein the dynamic range controller enables adjustment of at least one of the upper sound level limit or the lower sound level limit.

Another example embodiment of an apparatus integral with, or attachable to, a protective headgear, wherein the microphone employs a trained gaussian mixture model, for sound directional identification and sound classification, that is applied to sound received via the microphone.

Another example embodiment of an apparatus integral with, or attachable to, a protective headgear, wherein the switch is a knob handle or a slide handle positioned on the outer casing of the protective headgear, and wherein the switch changes the force generated as a result of the change of the polarity of the second magnet.

Another example embodiment of an apparatus integral with, or attachable to, a protective headgear, wherein the on-ear headset supports Bluetooth functionality enabling connection between the on-ear headset and a pairing user device supporting Bluetooth functionality.

Another example embodiment of an apparatus integral with, or attachable to, a protective headgear, wherein the on-ear headset employs an active noise control process to reduce low frequency sound received via a microphone input of the on-ear headset.

DETAILED DESCRIPTION

The following detailed description is merely illustrative and is not intended to limit embodiments and/or application or uses of embodiments. Furthermore, there is no intention to be bound by any expressed or implied information presented in the preceding Background or Summary sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details, or with other methods, components, materials, etc. In other instances, well-known structures, materials, or operations are not shown or described in detail to avoid obscuring certain aspects.

Reference throughout this specification to "one embodiment," or "an embodiment," means that a particular feature, structure, or characteristic described in connection with the embodiment is included in at least one embodiment. Thus, the appearances of the phrase "in one embodiment," "in one aspect," or "in an embodiment," in various places throughout this specification are not necessarily all referring to the same embodiment. Furthermore, the particular features, structures, or characteristics may be combined in any suitable manner in one or more embodiments.

The words "exemplary" and/or "demonstrative" are used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

Figure 1:
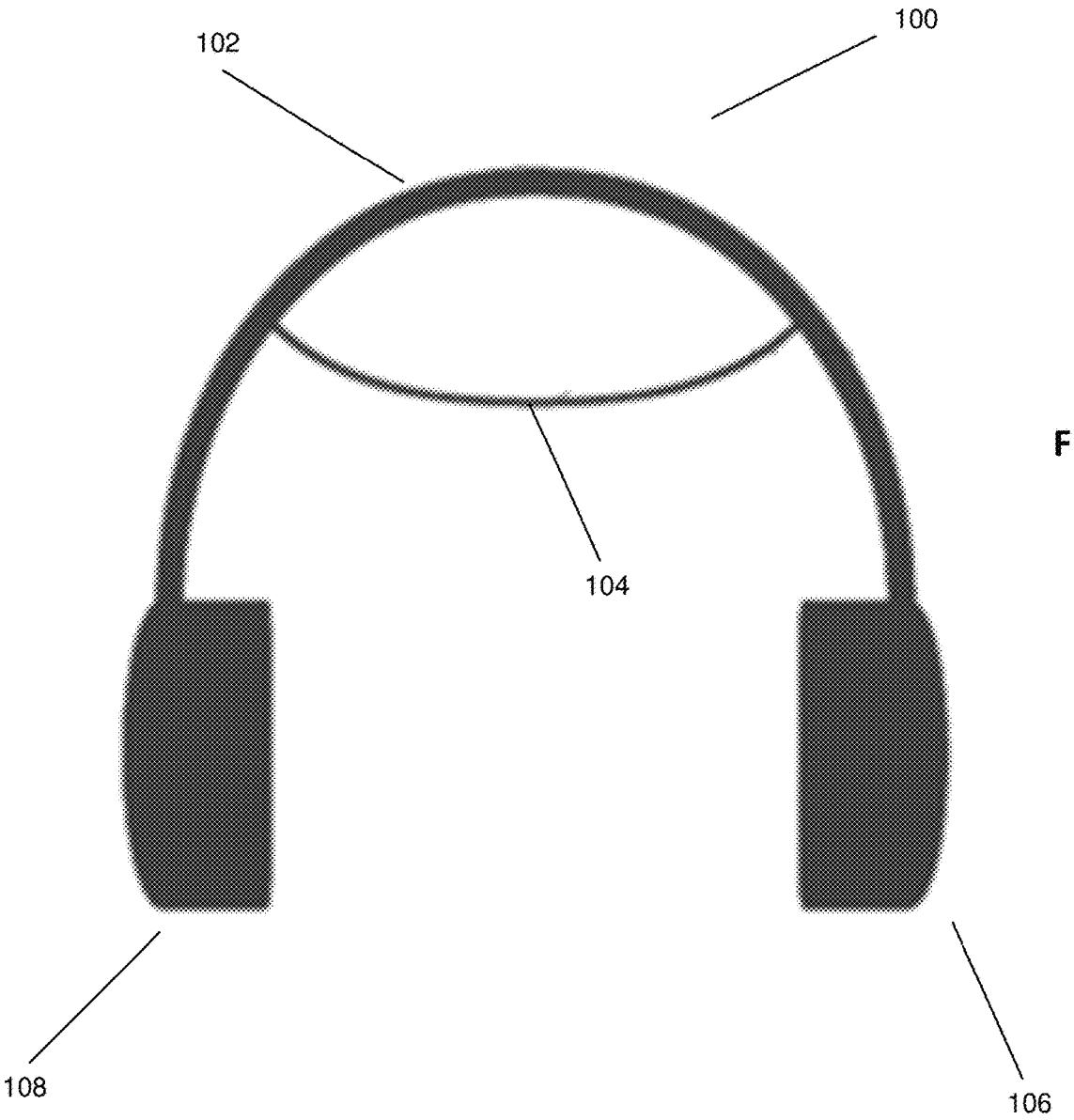
FIG. 1 illustrates an on-ear headset to be inserted into protective headgear.

Referring to FIG. 1, considering variations and alternative embodiments of an on-ear headset, the wearable device may be used for bidirectional communication enabling simultaneous two-way calling or alternate two-way calling under high noise conditions. It is possible for an on-hear headset to be worn inside of a protective headgear by electrically or mechanically opening and closing the headphone ear-cup when installing the headphone into the protective headgear.

In this regard, magnetic force means are adapted to actuate an ear cup mechanism upon a protective headgear receiving an on-ear headset. Magnetic force means include means for securing the on-ear headset to the protective headgear once the head band of the on-ear headset is inserted into a recess in the cushion-bendable material lining the inside of the protective headgear. The cushioned bendable material of the ear cup comprises at least a portion that is dense paper of at least a threshold density.

FIG. 1 illustrates the on-ear headset 100 which can be easily installed into a protective headgear. The headset 100 provides a headband 102 having a central head-engaging portion and a rubber support band 104. The headband 102 may be constructed of abs plastic, fiberglass, ceramic, wood, steel, aluminum, or any other durable material. In some implementations, the headband 102 may be padded with polyurethane foam, viscoelastic foam, rubber, leather, or other suitable material to provide comfort for the user's head.

Each earphone unit 106, 108 houses a speaker assembly enclosed within an ear cup. Each earphone unit 106, 108 may include a frame coupled between an ear pad and the ear cup of a protective head gear. The earphone units 106, 108 include a magnet on its frame to attach the on-ear headset 100 by magnetic force to the ear cups of the protective headgear.

Figure 2:
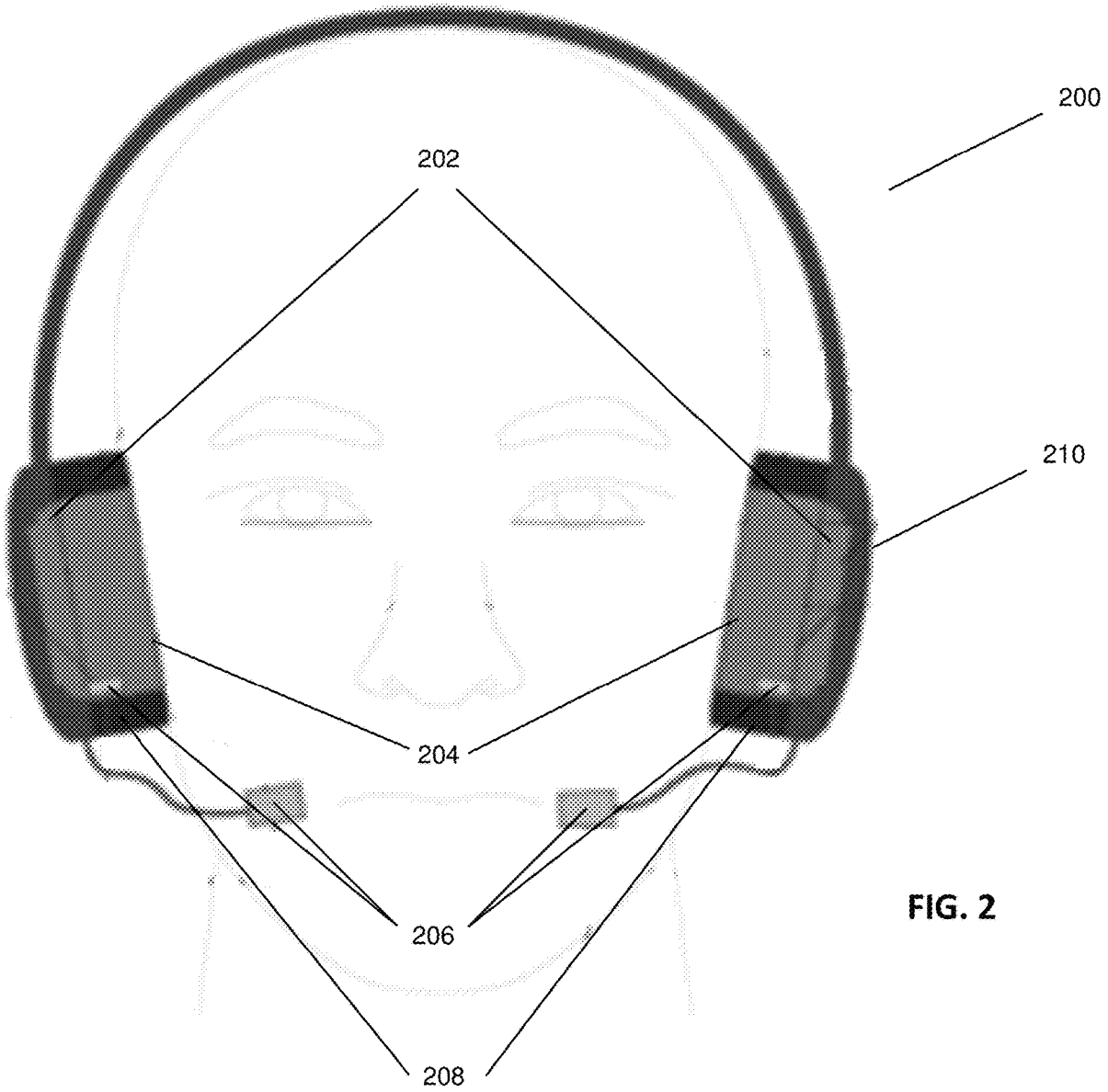
FIG. 2 illustrates an on-ear headset placed on the head of a user.

Referring to FIG. 2, there is illustrated an on-ear headset 200 placed on the head of a user. The on-ear headset 200 includes speakers 202. The speakers 202 are disposed in a sound outlet and are located in an accommodating space. In some embodiments, an ANC processing can occur at a connected device that receives two or more microphone signals, and produces one or more noise cancellation signals that are inserted into sound data output to the speakers 202. In some implementations speakers 202 can include distinct speaker components or a single speaker device; for example, speakers 202 can each include different speaker devices, including, but not limited to, a tweeter and a woofer.

A further embodiment of the on-ear headset 200, wherein the on-ear headset 200 is coupled to a dynamic range controller that enables setting of at least one of an upper sound level limit or a lower sound level limit for sound output to a user via the on-ear headset 200, and wherein the dynamic range controller enables adjustment of at least one of the upper sound level limit or the lower sound level limit.

The noise reduction can be accomplished using either passive or active methods. The passive methods have the advantage of using mechanical means only and thereby requiring no power source but often the disadvantage of a larger and more bulky design to include the acoustic absorptive or reflective materials. The active methods provide active noise compensation (ANC) by measuring the ambient noise level and producing a suitable anti-noise signal that is sent to the headphones or earphones so as to significantly attenuate the noise level at the ear. The on-ear headset employs an active noise control process to reduce low frequency sound received via the microphone array 206 of the on-ear headset 200. The advantage of using ANC is in the range 5-25 dB of attenuation in a frequency band of width 1-3 kHz. An often used application of ANC is noise suppression in noisy environments, because of the high noise level and the desire for a good audio experience. By using headphones equipped with ANC, the fatigue associated with noise pollution may be reduced.

In order to provide for ANC, at least two microphones in a microphone array 206 are needed in the on-ear headset 200, one proximate to each ear of the user, because the noise level varies with distance and time. ANC is usually either feed-forward or feed-backward noise suppression, although in some more expensive solutions may use four microphones in a dual system employing both feed-forward and feed-backward noise suppression.

Feed-forward systems work by measuring the noise outside the on-ear headset 200 and predicting the noise level inside the on-ear headset 200 in an isolation chamber 204, using estimates of the acoustic transfer function from the outside to the inside of the isolation chamber 204. Feed-backward systems measure the sound pressure level directly inside the isolation chamber 204 and compare this to the desired sound pressure level. Due to the delay in processing, feed-backward systems may suffer from a lower bandwidth of the noise suppression system but have the advantage of not needing a precisely determined transfer function between the inside and outside of the isolation chamber 204.

The microphone array 206 captures sound directional input and voice input from sound input received via the microphone array 206.

In some embodiments, the microphone array 206 may also be used for binaural recording and thereby enable binaural phone calls providing a more realistic sound environment. Binaural recordings enable very realistic playback experience because the sound is recorded right at each ear and thereby enables authentic playback.

A further of the on-ear headset 200, wherein the on-ear headset supports Bluetooth functionality enabling connection between the on-ear headset and a pairing user device supporting Bluetooth functionality. The embedded Bluetooth can also be used to setup a local area network for full duplex wireless communication among the users connected to the network.

The ANC circuit also requires power, which means the on-ear headset 200 will need single use or rechargeable batteries. Due to the need to power the ANC process, the headphones may require new batteries on a regular basis or may need to have its batteries recharged on a regular basis.

In accordance with one aspect of the present application, multiple ANC microphone signals are analog multiplexed into a combined analog signal requiring only one wire in the headphone cable. The use of analog multiplexing avoids potential ground bounce issues with mixing digital and analog solutions, and can be implemented in very cost effective circuitry without requiring a local power source (i.e. battery) in the headphones or headset. Such an arrangement may be implemented using an existing 4-terminal audio plug, thereby making the on-ear headset 200 backwards compatible with existing audio sockets.

The isolation earpads 208 are made of soft, flexible material, such as rubber, cloth, leather, or any other durable compliant material. As shown, the ear muff body 210 may be oval shaped, but in other implementations the body may be circular or any other suitable geometry. In the present implementation, the ear muff body 210 may be padded, for example with foam, to cushion the user's ear. The isolation earpads 208 may include an insert comprising a sheet of open-cell sound dampening material, for example an open-cell polyethylene, polyurethane, or polypropylene foam, that is glued or otherwise bonded between isolation earpads 208.

The ear muff body 210 forms an opening for channeling sound to the user's ear. In some implementations, a cloth or mesh fabric, extending across the ear pad opening, may be affixed to the back surface of the ear muff body 210 to protect the user's ear from the earphone unit components. The ear muff body 210 may be made of injection molded plastic, ceramic, or any other suitable material.

The sound conditioning properties (i.e., the mechanical and acoustic performance) of the open-cell material may be adjusted by fastening the on-ear headset 200 and the protective headgear closer together. By fastening the on-ear headset 200 and the protective headgear closer together, the cells of the open-cell material are compressed which, in turn, absorbs acoustic energy and restricts the passage of sound waves propagating through the material. Thus, the amplitude of sound heard by the user through the speakers 202 may be adjusted by adjusting the spacing between the on-ear headset 200 and protective headgear. In addition to adjusting the spacing between the on-ear headset 200 and the protective headgear, the amplitude of attendant sound may be adjusted by using sound dampening materials of various thicknesses and mechanical properties. Further, in some implementations, damaged or worn inserts may be replaced by the manufacturer or user.

Figure 3:
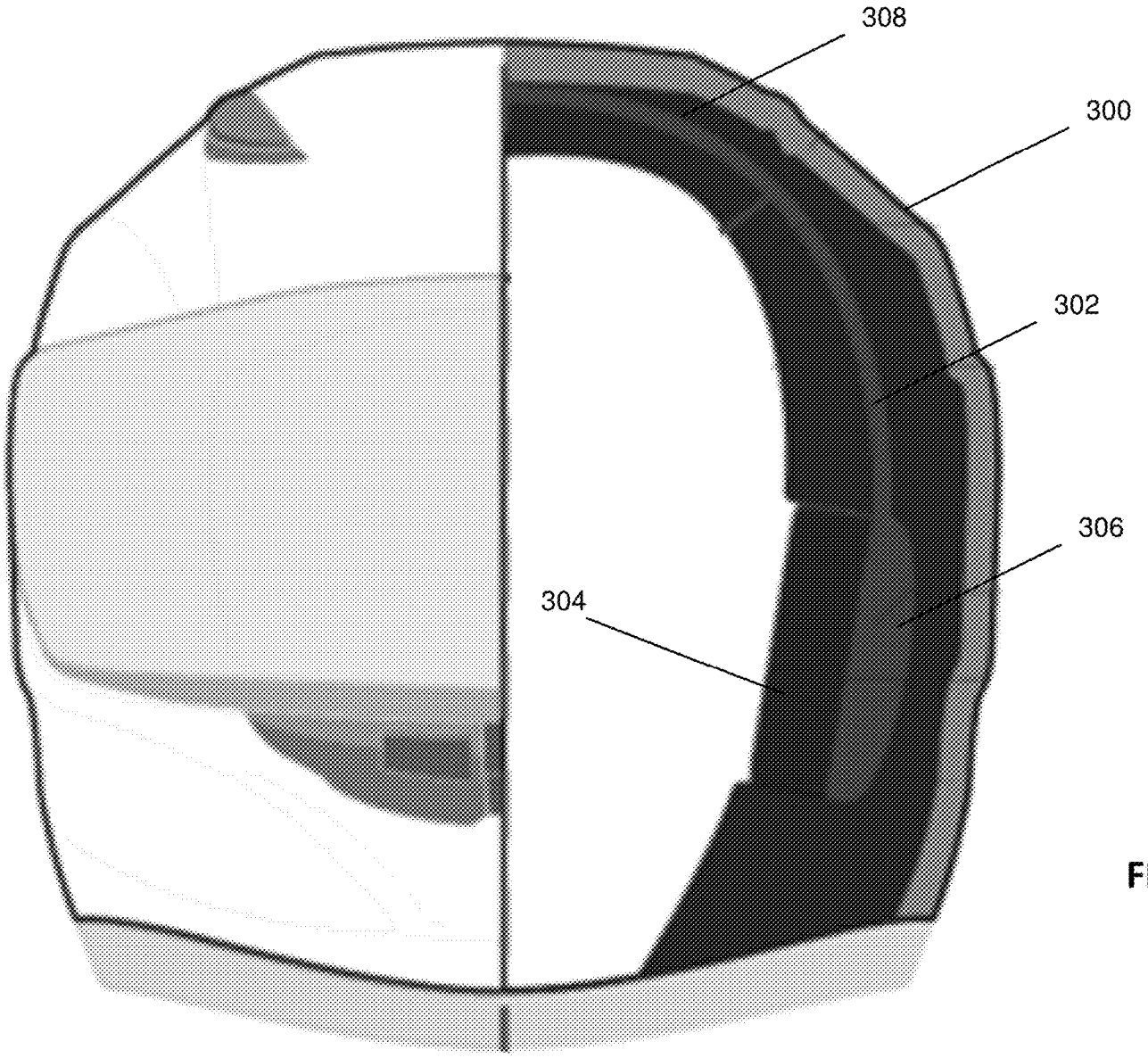
FIG. 3 illustrates the front view of a user wearing an on-ear headset and protective headgear.

Referring to the non-limiting example embodiments of FIG. 3, the protective headgear 300 having the on-ear headset 302 inserted by the user therein to allow the user to wear the on-ear headset 302 and listen to sounds. The on-ear headset 302 includes the pair of speakers, the microphone array, the ANC circuit connected to one of the speakers and the battery unit including the battery for supplying power to the speakers and the ANC circuit. The battery unit is connected to another speaker.

The on-ear headset band is flexible to allow the user to easily insert the speaker device into the slot of the protective headgear 300. At least one wire extends through the band in the recess channel defined therein. The wire is operably communicated with the speakers, the microphone array, the ANC circuit, and the battery unit to supply power thereto. The band is fabricated from a flexible material, and when connecting the on-ear headset and the protective headgear 300 the band forms a unitary element thereby allowing the user to flex the on-ear headset band to insert the on-ear headset 302 into the opening and move the on-ear headset around the pocket thereby completely hiding the on-ear headset 302 within the protective headgear 300 to allow the user to listen to sounds as the user wears the protective headgear 300.

The isolation earpads 304 are mainly composed of a donut-shaped cushioning member (for example, a sponge-like member). The isolation earpads 304 are compressed with a predetermined degree of adhesion by fastening the on-ear headset 302 to the protective headgear 300 with magnetism formed by an array of magnets.

The ear muff body 306 is sucked into the ear cup of the protective headgear 300 by a magnet of opposite polarity. When the user puts on the protective headgear, the headband 308 is pushed up ward into a recess provided by the protective headgear and the magnetic polarity will change. When the polarity of the magnet of the ear muff body 306 are the same as those embedded onto a switching mechanism. The magnetic force will repel each other and will force the ear-cup outward towards the user's head.

Referring to the non-limiting example embodiments of FIG. 4, the protective headgear 400 including a switching mechanism 402. The switching mechanism 402 may be a push or clickable button(s), a sliding toggle button or switch, a rotating dial or knob, a motion controlling device (such as a joystick or navigation pad), and/or the like. The switching mechanism may be incorporated into any electronic device to control various aspects of the protective headgear 400. Alternatively, the switching mechanism 402 may be a stand-alone device that operatively couples to the protective headgear 400 through wired or wireless connections. For example, the switching mechanism 402 may be a peripheral input/output device that connects to the protective headgear 400. In either case, the switching mechanism 402 can be configured to generate commands, make selections and/or control movements in the protective headgear 400.

Figure 4A:
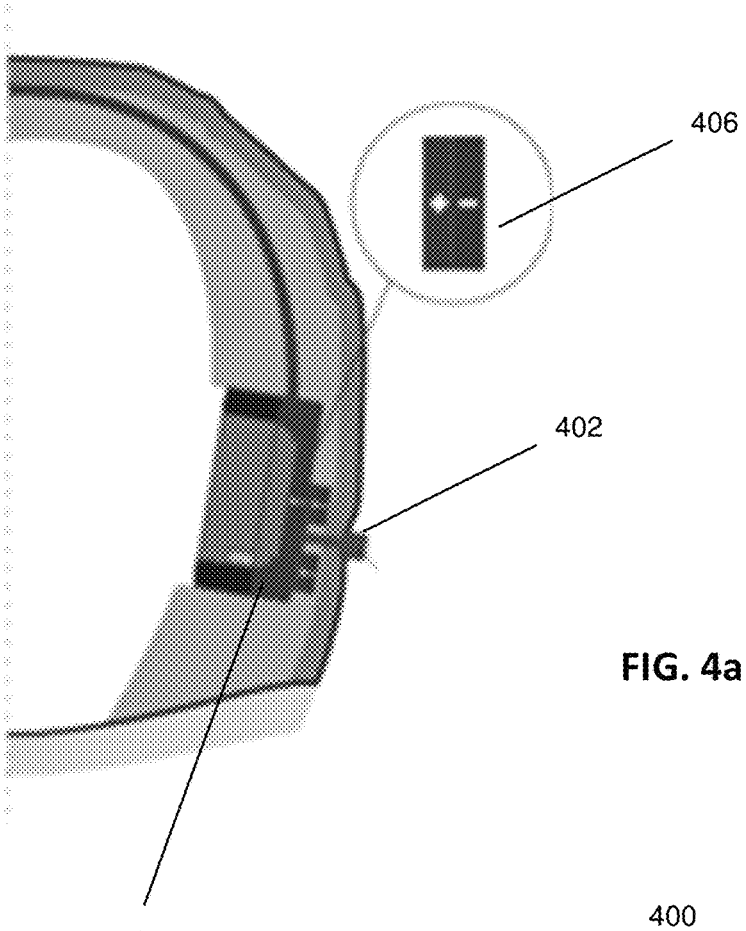
FIG. 4*a* illustrates the front view of the ear cup magnet switch.
Figure 4B:
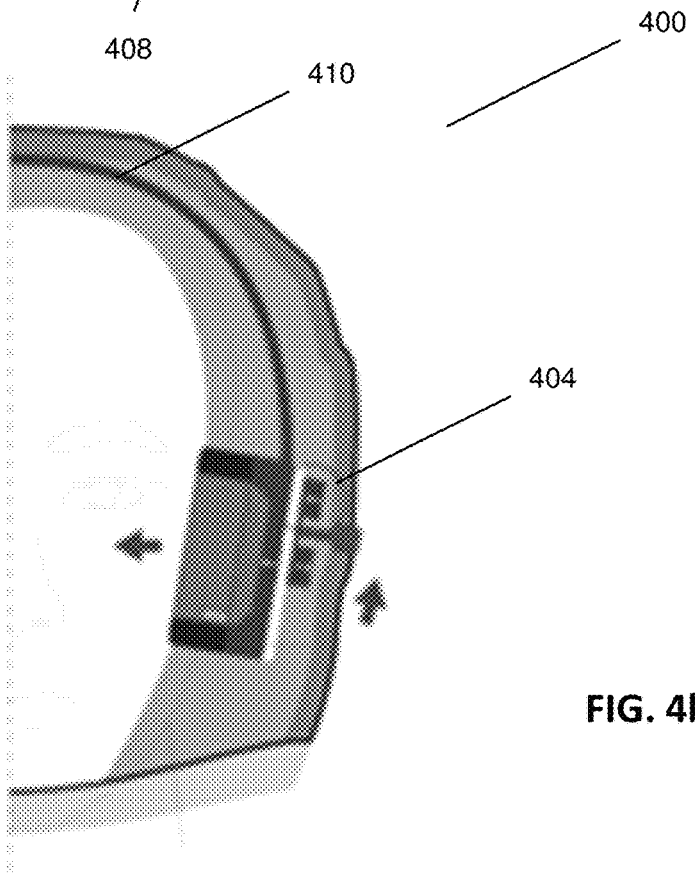
FIG. 4*b* illustrates the front view of the ear cup magnet switching action.

As shown in FIGS. 4A and 4B, the switching mechanism 402 is configured to slide in for example the x and/or y directions in a manner similar to a sliding switch. By way of example, the headgear magnets 404 may slide between a first position and a second position in order to emit a positive or negative polarity to the earphone magnets 406. In some cases, the switching mechanism 402 may also be configured to slide in the x/y plane thereby covering both the x and y directions as well as diagonals located therebetween.

In order to produce the various movements, the switching mechanism 402 may be coupled to the protective headgear 400 through various axels, pivot joints, slider joints, ball and socket joints, flexure joints, magnetic joints, roller joints, and/or the like. By way of example, and not by way of limitation, an axel may be used in the embodiment shown in FIGS. 4A and 4B, a pivot joint utilizing for example pivot pins or a flexure may be used in the embodiment shown in FIGS. 4A and 4B, and a slider joint utilizing for example a channel arrangement may be used in the embodiments shown in FIGS. 4A and 4B. The headgear magnets 404 may additionally be made movable through a combination of joints such as a pivot/sliding joint, pivot/flexure joint, sliding/flexure joint, pivot/pivot joint, in order to increase the range of motion (e.g., increase the degree of freedom).

Any suitable mechanical, electrical and/or optical switch, sensor or encoder may be used. For example, tact switches, force sensitive resistors, pressure sensors, proximity sensors, infrared sensors, mechanical or optical encoders and/or the like may be used in any of the arrangement described above.

In one particular embodiment, the switching mechanism 402 is a sliding switch that is divided into two independent and spatially distinct headgear magnets 404 that are positioned throughout earcup of the protective headgear 400 according to polarity. The headgear magnets 404, which are typically hidden from view, are coupled to the switching mechanism 402 and represent a different polarity on the surface of the magnet. The headgear magnets 404 may be positioned in a grid or in a straight line where each polarized magnet is capable of being positioned to the earphone magnets 406. That is, the switching mechanism 402 moving from a first position to a second position is caused to actuate a first magnet having a first polarity to change to a second magnet having a second polarity. In the simplest case, a polarity change is produced each time the switching mechanism 402 is employed. When the switching mechanism 402 is employed, the headgear magnets 404 are placed over attracting earphone magnets 406 which sucks the on-ear headset ear muff body 408 into the earcup of the protective headgear. When the switching mechanism 402 is moved, the headgear magnets 404 repel from the earphone magnets 406 releasing the on-ear headset 410 from the protective headgear 400.

Referring to the non-limiting example embodiments of FIG. 5, the rotary mechanism 502 is configured to rotate in for example the clockwise or counter-clockwise directions in a manner similar to a dimming switch. By way of example, the headgear magnets 504 may rotate between a first position and a second position in order to emit a positive or negative polarity to the earphone magnets 506.

Figure 5A:
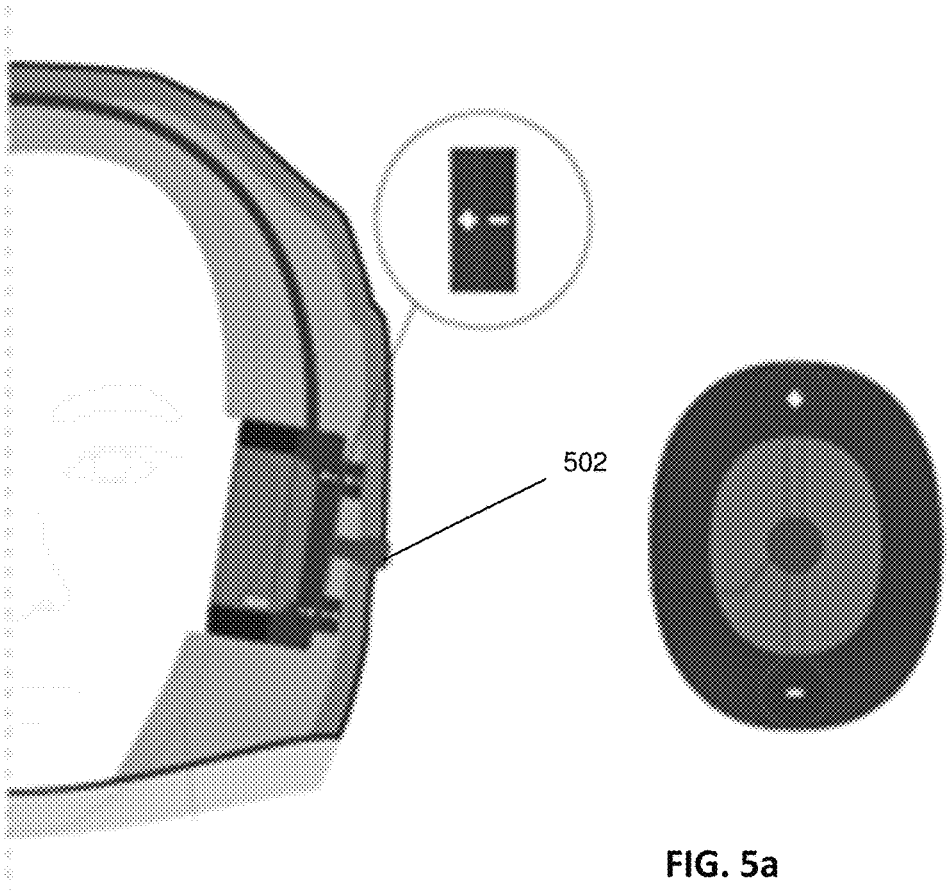
FIG. 5*a* illustrates a top view of the magnet knob.
Figure 5B:
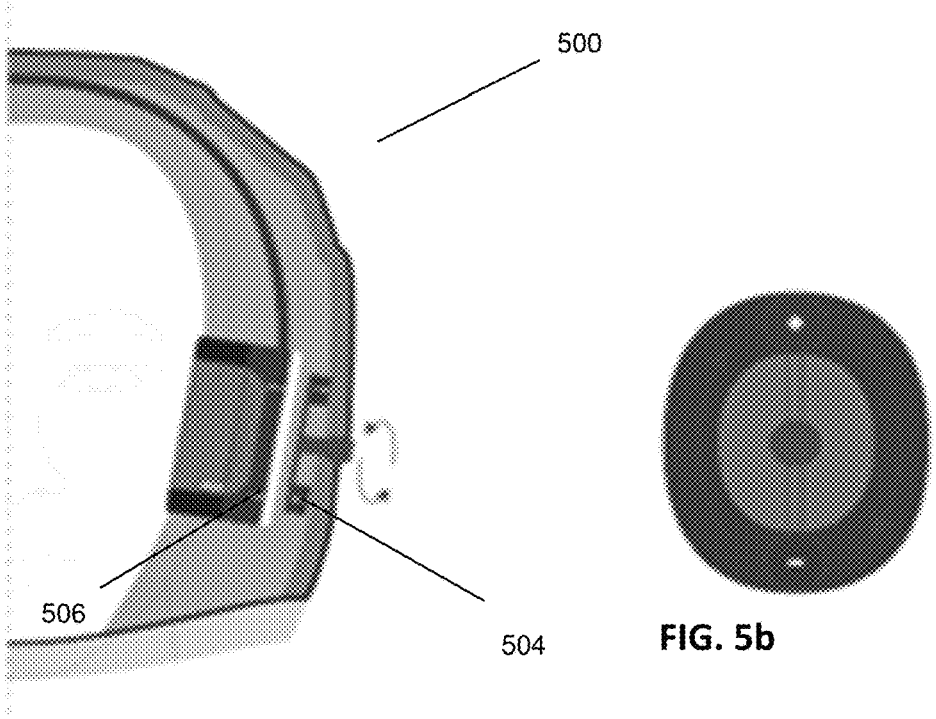
FIG. 5*b* illustrates a top view of the magnet knob turning action.

An aspect of the disclosure as shown in FIGS. 5A and 5B, a rotary mechanism 502 comprising a housing accommodating at least a first rotary contact and a second rotary contact arranged for being rotatable about an axis of rotation, and at least a first stationary contact and a second stationary contact. The first stationary contact comprises headgear magnets 504 arranged for being magnetically contacted by the earphone magnets 506 and comprises a repelling magnetism for releasing the on ear-headset from the protective headgear. The second stationary contact comprises headgear magnets 504 arranged for being magnetically contacted by the earphone magnets 506 and comprises an attracting magnetism for sucking the on-ear headset muff body into the earcup of the protective headgear. The first and second stationary contacts are arranged offset in the axial direction and the angular direction with respect to the axis of rotation. The first and second rotary contacts are arranged for concurrently contacting the first and second stationary contacts, respectively, in a first rotary orientation about the common axis of rotation.

The rotary mechanism 502 may further have a third and a fourth stationary contact, the third stationary contact comprising a contact portion arranged for being contacted by the first rotary contact concurrently with the first stationary contact, the fourth stationary contact comprising a contact portion arranged for being contacted by the second rotary contact concurrently with the second stationary contact The headgear magnets 504 and the connection portion of at least one of the first or second stationary contacts, possibly also of at least one of the third or fourth stationary contacts, are oriented at an angle to each other in at least one of the radial direction and the axial direction with respect to the axis of rotation. This allows to spatially arrange the headgear magnets 504 and the connecting portions in a desired manner, e.g. for facilitating connecting the headgear magnets 504 to the rotary mechanism 502. It also allows to optimize the magnetism for the polarity to be switchable by the rotary mechanism 502.

The rotary mechanism 502 accommodates the spindle knob for operably rotating the headgear magnets 504. The spindle knob comprises a shaft portion, a connection portion and an optional support portion. The spindle knob is mounted to the shaft portion and may be supported by the support portion. The shaft portion is shaped for operably imparting a rotational force to headgear magnets 504. By the present arrangement, a single rotation operation will rotate all mechanically connected headgear magnets 504 together.

Figure 6:
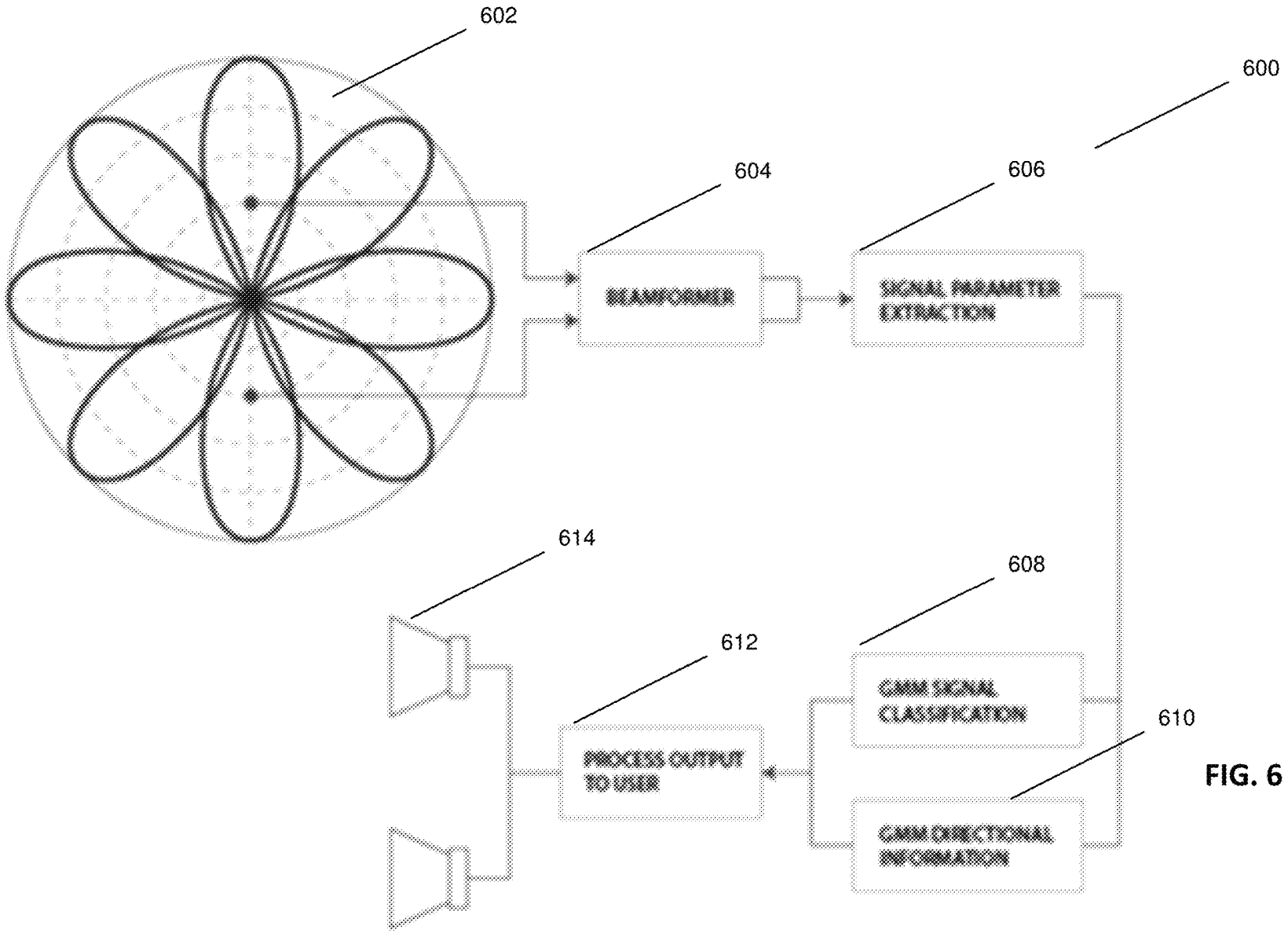
FIG. 6 illustrates a diagram of the sound directional information array.

Referring to the non-limiting example embodiments of FIG. 6, a plurality of microphones may be used to form a microphone array 602. The microphone array may include an AI driven model for hear through with sound directional information. The microphone array 602 employs a gaussian mixture model to identify and classify the hazard. A signal processor 600, coupled to the on-ear headset, receives sound data from the microphone array. Sound data is then processed by receive beamforming. The primary task of a beamformer 604 is to determine and sum the coherent signals from targets received by the microphone array 602. Additionally, the beamformer 604 comprises a means for processing a signal which is representative of one or more beams, with this processing including means for adjusting the spatial range resolution (receive signal bandwidth) depending on the number of beams represented by the signal. Further, the adjustment of the receive signal spatial range resolution is also related to the receive signal nominal center frequency for each beam.

The sound data is then processed by signal parameter extraction 606. Extraction of features of the sound data gives better accuracy in a noisy environment. To train any statistical or ML model, useful features are first extracted from the sound data. Audio feature extraction is a necessary step in audio signal processing, which is a subfield of signal processing. Signal parameter extraction 606 deals with the processing or manipulation of audio signals. Signal parameter extraction 606 removes unwanted noise and balances the time-frequency ranges by converting digital and analog signals. Signal parameter extraction 606 focuses on computational methods for altering the sounds. The sound data is then processed by Gaussian Mixture Modeling (GMM) Signal Classification 608 to identify a hazard based on an acoustic frequency of sound input received via the microphone array 602. Based on the sound input and the acoustic frequency, classifying the hazard as a type of hazard from a group of types of hazards. During this process, a number of acoustic features that include linear predictive coefficients, linear predictive cepstral coefficients and mel-frequency cepstral coefficients are extracted to characterize the audio content. GMM Signal Classification 608 is performed concurrently with GMM Direction Information 610. The signal processor 600 may now process the output to the user 612 and play the audio through the earphone speakers 614.

Figure 7:
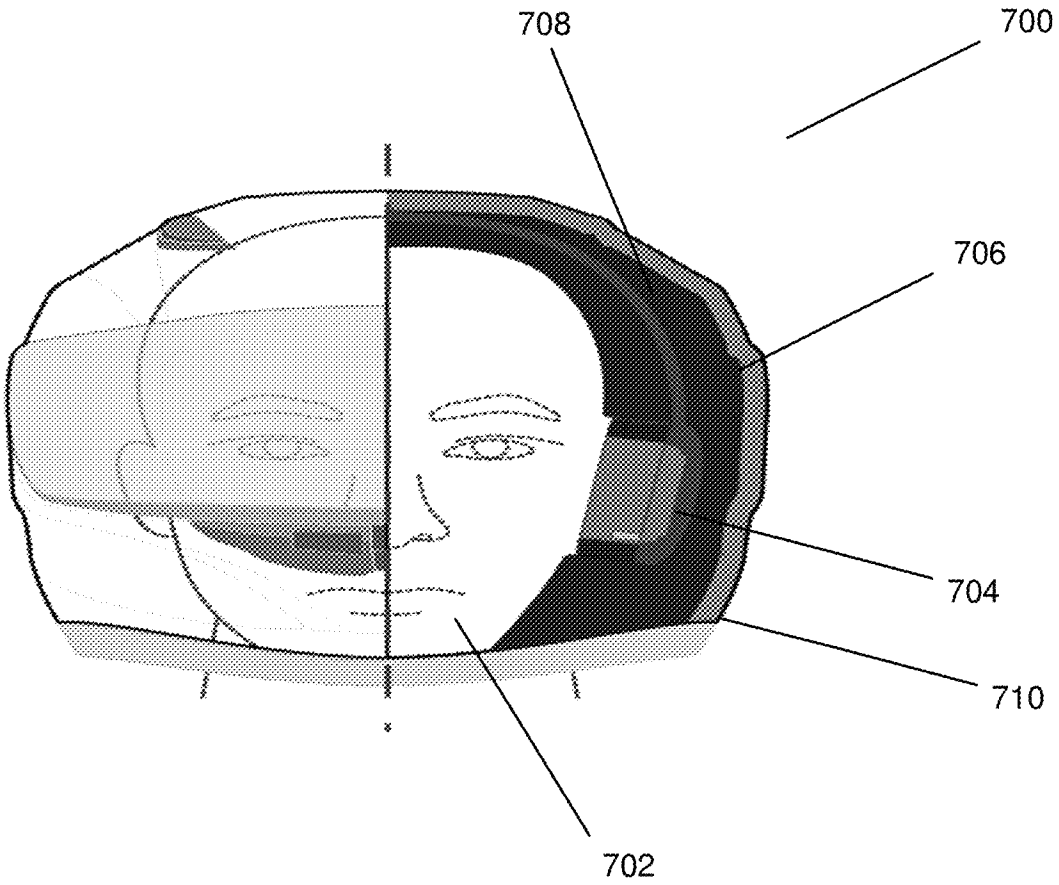
FIG. 7 illustrates the front view of a user wearing an on-ear headset and a protective headgear.

Referring to the non-limiting example embodiments of FIG. 7, the article of manufacture 700 is fully installed on the user's head 702. The user is wearing the on-ear headset 704. The user's head 702 and the on-ear headset 704 comfortable fits into the protective head gear by having the on a recess provided for the headband of the on-ear headset 704 and ear cup an ear cup portion to receive the ear muff portion of the on-ear headset 704.

The article of manufacture comprises compressible foam material 708 attachable to an inner portion of a headgear that is wearable on a head 702. The compressible foam material 708 comprises a recess for an on-ear headset, wherein, as the headgear is being positioned on the head, at least a part of the head 702 pushes a headband of the on-ear headset 704 into the recess of the compressible foam material 708, and wherein the compressible foam material 708 surrounds the on-ear headset 704 to reduce external noise originating in an external environment outside of the on-ear headset 704. A first magnet within an ear cup of the inside portion of the headgear that, as the headgear is being positioned on the head 702, attaches the on-ear headset 704 to the ear cup, wherein a magnetization exhibited by the first magnet reduces a gap between the compressible foam material 708 and the on-ear headset 704 relative to the magnetization being absent. A second magnet that, as a result of at least the part of the head 702 pushing the on-ear headset 704 into the recess of the compressible foam material 708, changes a polarity from a first polarity to a second polarity, wherein, when the polarity of the second magnet is the second polarity, the second magnet operates to pull the compressible foam material 708 towards an outer casing 710 of the headgear, and wherein, when the polarity of the second magnet is the first polarity, the second magnet operates to push the compressible foam material 708 towards the inner portion of the headgear.

The article of manufacture further comprises a switch to change the polarity of the second magnet, wherein the switch adjusts a force of the second magnet by adjusting a distance between the first magnet and the second magnet. The switch is a knob handle or a slide handle positioned on an outer casing of the headgear.

The article of manufacture further comprises a microphone array integral with, or attachable to, the protective headgear, wherein the microphone array is omni-directional, and wherein the microphone array obtains sound directional input to detect a hazard. The microphone array employs a gaussian mixture model to identify and classify the hazard. The microphone array obtains voice input for hands-free communication.

The article of manufacture further comprises a battery located in the ear cup to provide power to the headgear.

Figure 8:
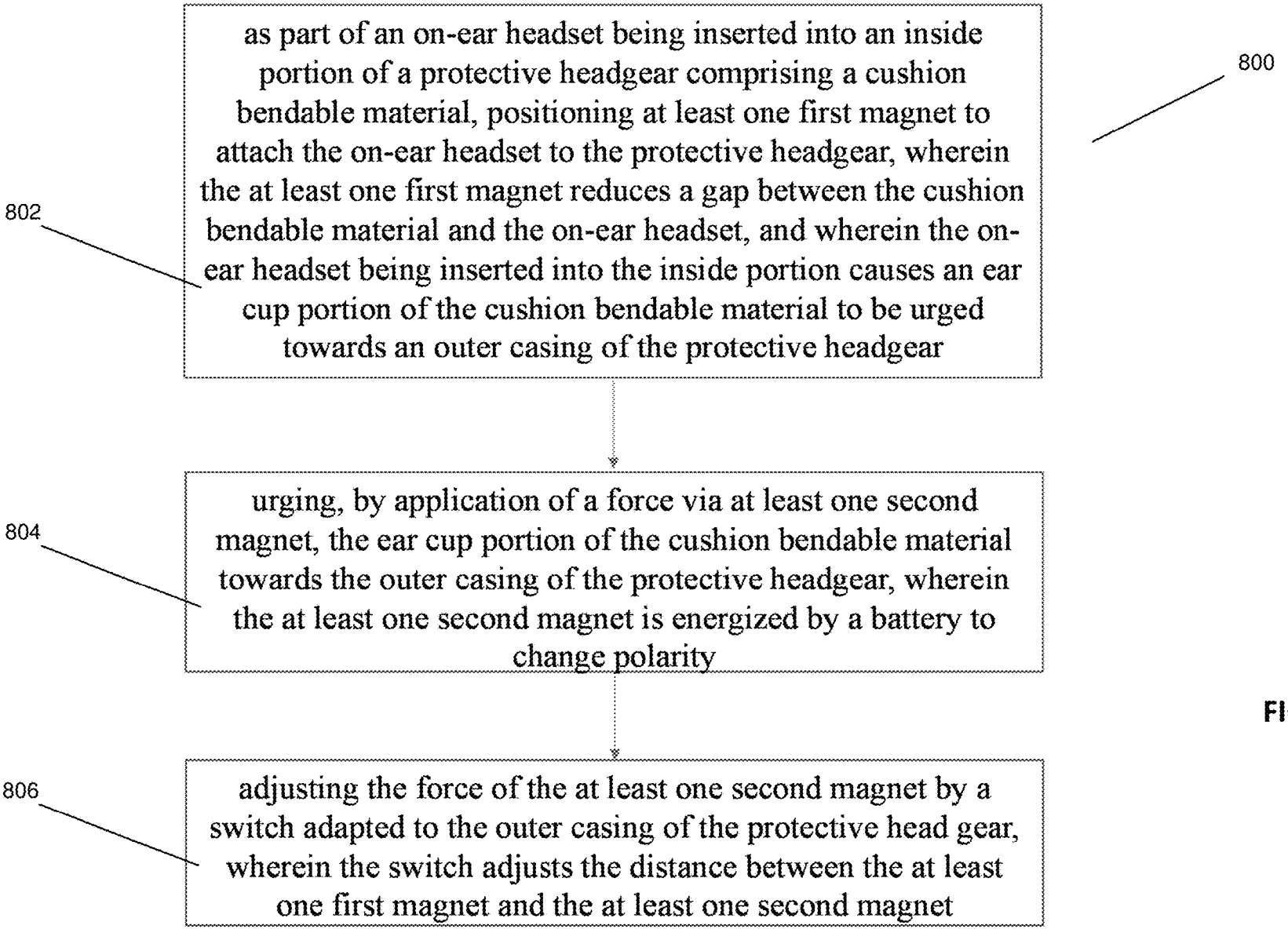
FIG. 8 illustrates a flow diagram for installing an on-ear headset into a protective headgear.

Referring now to FIG. 8, illustrated is a flow diagram 800 for installing an on-ear headset into a protective headgear in accordance with one or more embodiments described herein.

At 802, the flow diagram 800 comprises as part of an on-ear headset being inserted into an inside portion of a protective headgear comprising a cushion bendable material, positioning at least one first magnet to attach the on-ear headset to the protective headgear, wherein the at least one first magnet reduces a gap between the cushion bendable material and the on-ear headset, and wherein the on-ear headset being inserted into the inside portion causes an ear cup portion of the cushion bendable material to be urged towards an outer casing of the protective headgear.

At 804, the flow diagram 800 comprises urging, by application of a force via at least one second magnet, the ear cup portion of the cushion bendable material towards the outer casing of the protective headgear, wherein the at least one second magnet is energized by a battery to change polarity.

At 806, the flow diagram 800 comprises adjusting the force of the at least one second magnet by a switch adapted to the outer casing of the protective head gear, wherein the switch adjusts the distance between the at least one first magnet and the at least one second magnet.

The installing an on-ear headset into a protective headgear further comprises changing the polarity of the at least one second magnet, wherein the application of the force via the at least one second magnet is powered by a battery coupled to the switch and positioned inside the ear cup portion.

The installing an on-ear headset into a protective headgear further comprises urging, by application of another force via at least one second magnet, the at least one second magnet to urge the ear cup portion of the cushion bendable material towards the inner portion of the protective gear.

The installing an on-ear headset into a protective headgear further comprises employing a microphone array for detection of a hazard, comprising: identifying the hazard based on an acoustic frequency of sound input received via the microphone array, and based on the sound input and the acoustic frequency, classifying the hazard as a type of hazard from a group of types of hazards.

Figure 9:
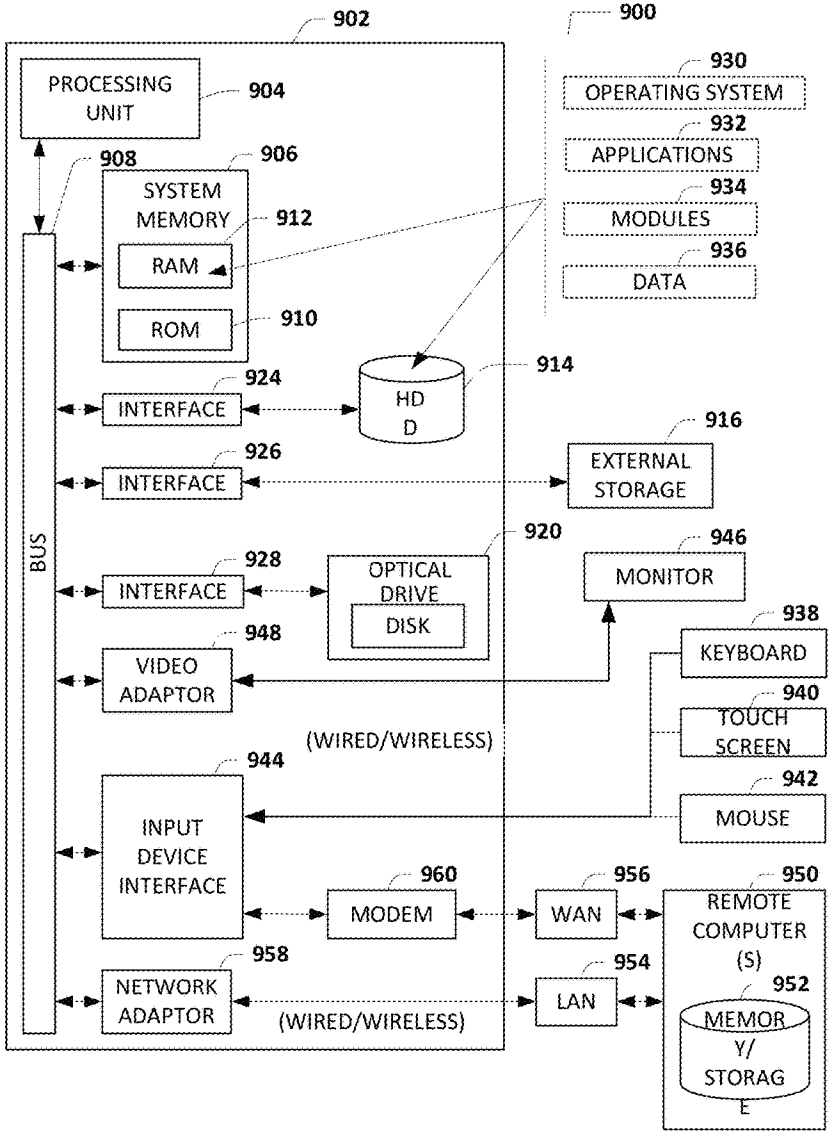
FIG. 9 illustrates illustrates a non-limiting computing environment in which one or more embodiments described herein can be implemented.

In order to provide additional context for various embodiments described herein, FIG. 9 and the following discussion are intended to provide a brief, general description of a suitable computing environment 900 in which the various embodiments of the embodiment described herein can be implemented. While the embodiments have been described above in the general context of computer-executable instructions that can run on one or more computers, those skilled in the art will recognize that the embodiments can be also implemented in combination with other program modules and/or as a combination of hardware and software.

Generally, program modules include routines, programs, components, data structures, etc., that perform particular tasks or implement particular abstract data types. Moreover, those skilled in the art will appreciate that the inventive methods can be practiced with other computer system configurations, including single-processor or multiprocessor computer systems, minicomputers, mainframe computers, Internet of Things (IoT) devices, distributed computing systems, as well as personal computers, hand-held computing devices, microprocessor-based or programmable consumer electronics, and the like, each of which can be operatively coupled to one or more associated devices.

The illustrated embodiments of the embodiments herein can be also be practiced in distributed computing environments where certain tasks are performed by remote processing devices that are linked through a communications network. In a distributed computing environment, program modules can be located in both local and remote memory storage devices.

Computing devices typically include a variety of media, which can include computer-readable storage media, machine-readable storage media, and/or communications media, which two terms are used herein differently from one another as follows. Computer-readable storage media or machine-readable storage media can be any available storage media that can be accessed by the computer and includes both volatile and nonvolatile media, removable and non-removable media. By way of example, and not limitation, computer-readable storage media or machine-readable storage media can be implemented in connection with any method or technology for storage of information such as computer-readable or machine-readable instructions, program modules, structured data or unstructured data.

Computer-readable storage media can include, but are not limited to, random access memory (RAM), read only memory (ROM), electrically erasable programmable read only memory (EEPROM), flash memory or other memory technology, compact disk read only memory (CD-ROM), digital versatile disk (DVD), Blu-ray disc (BD) or other optical disk storage, magnetic cassettes, magnetic tape, magnetic disk storage or other magnetic storage devices, solid state drives or other solid state storage devices, or other tangible and/or non-transitory media which can be used to store desired information. In this regard, the terms "tangible" or "non-transitory" herein as applied to storage, memory or computer-readable media, are to be understood to exclude only propagating transitory signals per se as modifiers and do not relinquish rights to all standard storage, memory or computer-readable media that are not only propagating transitory signals per se.

Computer-readable storage media can be accessed by one or more local or remote computing devices, e.g., via access requests, queries or other data retrieval protocols, for a variety of operations with respect to the information stored by the medium.

Communications media typically embody computer-readable instructions, data structures, program modules or other structured or unstructured data in a data signal such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

With reference again to FIG. 9, the example environment 900 for implementing various embodiments of the aspects described herein includes a computer 902, the computer 902 including a processing unit 904, a system memory 906 and a system bus 908. The system bus 908 couples system components including, but not limited to, the system memory 906 to the processing unit 904. The processing unit 904 can be any of various commercially available processors. Dual microprocessors and other multi-processor architectures can also be employed as the processing unit 904.

The system bus 908 can be any of several types of bus structure that can further interconnect to a memory bus (with or without a memory controller), a peripheral bus, and a local bus using any of a variety of commercially available bus architectures. The system memory 906 includes ROM 910 and RAM 912. A basic input/output system (BIOS) can be stored in a non-volatile memory such as ROM, erasable programmable read only memory (EPROM), EEPROM, which BIOS contains the basic routines that help to transfer information between elements within the computer 902, such as during startup. The RAM 912 can also include a high-speed RAM such as static RAM for caching data.

The computer 902 further includes an internal hard disk drive (HDD) 914 (e.g., EIDE, SATA), one or more external storage devices 916 (e.g., a magnetic floppy disk drive (FDD) 916, a memory stick or flash drive reader, a memory card reader, etc.) and an optical disk drive 920 (e.g., which can read or write from a CD-ROM disc, a DVD, a BD, etc.). While the internal HDD 914 is illustrated as located within the computer 902, the internal HDD 914 can also be configured for external use in a suitable chassis (not shown). Additionally, while not shown in environment 900, a solid state drive (SSD) could be used in addition to, or in place of, an HDD 914. The HDD 914, external storage device(s) 916 and optical disk drive 920 can be connected to the system bus 908 by an HDD interface 924, an external storage interface 926 and an optical drive interface 928, respectively. The interface 924 for external drive implementations can include at least one or both of Universal Serial Bus (USB) and Institute of Electrical and Electronics Engineers (IEEE) interface technologies. Other external drive connection technologies are within contemplation of the embodiments described herein.

The drives and their associated computer-readable storage media provide nonvolatile storage of data, data structures, computer-executable instructions, and so forth. For the computer 902, the drives and storage media accommodate the storage of any data in a suitable digital format. Although the description of computer-readable storage media above refers to respective types of storage devices, it should be appreciated by those skilled in the art that other types of storage media which are readable by a computer, whether presently existing or developed in the future, could also be used in the example operating environment, and further, that any such storage media can contain computer-executable instructions for performing the methods described herein.

A number of program modules can be stored in the drives and RAM 912, including an operating system 930, one or more application programs 932, other program modules 934 and program data 936. All or portions of the operating system, applications, modules, and/or data can also be cached in the RAM 912. The systems and methods described herein can be implemented utilizing various commercially available operating systems or combinations of operating systems.

Computer 902 can optionally comprise emulation technologies. For example, a hypervisor (not shown) or other intermediary can emulate a hardware environment for operating system 930, and the emulated hardware can optionally be different from the hardware illustrated in FIG. 7. In such an embodiment, operating system 930 can comprise one virtual machine (VM) of multiple VMs hosted at computer 902. Furthermore, operating system 930 can provide runtime environments, such as the Java runtime environment or the .NET framework, for applications 932. Runtime environments are consistent execution environments that allow applications 932 to run on any operating system that includes the runtime environment. Similarly, operating system 930 can support containers, and applications 932 can be in the form of containers, which are lightweight, standalone, executable packages of software that include, e.g., code, runtime, system tools, system libraries and settings for an application.

Further, computer 902 can be enabled with a security module, such as a trusted processing module (TPM). For instance with a TPM, boot components hash next in time boot components, and wait for a match of results to secured values, before loading a next boot component. This process can take place at any layer in the code execution stack of computer 902, e.g., applied at the application execution level or at the operating system (OS) kernel level, thereby enabling security at any level of code execution.

A user can enter commands and information into the computer 902 through one or more wired/wireless input devices, e.g., a keyboard 938, a touch screen 940, and a pointing device, such as a mouse 942. Other input devices (not shown) can include a microphone, an infrared (IR) remote control, a radio frequency (RF) remote control, or other remote control, a joystick, a virtual reality controller and/or virtual reality headset, a game pad, a stylus pen, an image input device, e.g., camera(s), a gesture sensor input device, a vision movement sensor input device, an emotion or facial detection device, a biometric input device, e.g., fingerprint or iris scanner, or the like. These and other input devices are often connected to the processing unit 904 through an input device interface 944 that can be coupled to the system bus 908, but can be connected by other interfaces, such as a parallel port, an IEEE serial port, a game port, a USB port, an IR interface, a BLUETOOTH® interface, etc.

A monitor 946 or other type of display device can be also connected to the system bus 908 via an interface, such as a video adapter 948. In addition to the monitor 946, a computer typically includes other peripheral output devices (not shown), such as speakers, printers, etc.

The computer 902 can operate in a networked environment using logical connections via wired and/or wireless communications to one or more remote computers, such as a remote computer(s) 950. The remote computer(s) 950 can be a workstation, a server computer, a router, a personal computer, portable computer, microprocessor-based entertainment appliance, a peer device or other common network node, and typically includes many or all of the elements described relative to the computer 902, although, for purposes of brevity, only a memory/storage device 952 is illustrated. The logical connections depicted include wired/wireless connectivity to a local area network (LAN) 954 and/or larger networks, e.g., a wide area network (WAN) 956. Such LAN and WAN networking environments are commonplace in offices and companies, and facilitate enterprise-wide computer networks, such as intranets, all of which can connect to a global communications network, e.g., the Internet.

When used in a LAN networking environment, the computer 902 can be connected to the local network 954 through a wired and/or wireless communication network interface or adapter 958. The adapter 958 can facilitate wired or wireless communication to the LAN 954, which can also include a wireless access point (AP) disposed thereon for communicating with the adapter 958 in a wireless mode.

When used in a WAN networking environment, the computer 902 can include a modem 960 or can be connected to a communications server on the WAN 956 via other means for establishing communications over the WAN 956, such as by way of the Internet. The modem 960, which can be internal or external and a wired or wireless device, can be connected to the system bus 908 via the input device interface 944. In a networked environment, program modules depicted relative to the computer 902 or portions thereof, can be stored in the remote memory/storage device 952. It will be appreciated that the network connections shown are example and other means of establishing a communications link between the computers can be used.

When used in either a LAN or WAN networking environment, the computer 902 can access cloud storage systems or other network-based storage systems in addition to, or in place of, external storage devices 916 as described above. Generally, a connection between the computer 902 and a cloud storage system can be established over a LAN 954 or WAN 956 e.g., by the adapter 958 or modem 960, respectively. Upon connecting the computer 902 to an associated cloud storage system, the external storage interface 926 can, with the aid of the adapter 958 and/or modem 960, manage storage provided by the cloud storage system as it would other types of external storage. For instance, the external storage interface 926 can be configured to provide access to cloud storage sources as if those sources were physically connected to the computer 902.

The computer 902 can be operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, store shelf, etc.), and telephone. This can include Wireless Fidelity (Wi-Fi) and BLUETOOTH® wireless technologies. Thus, the communication can be a predefined structure as with a conventional network or simply an ad hoc communication between at least two devices.

Figure 10:
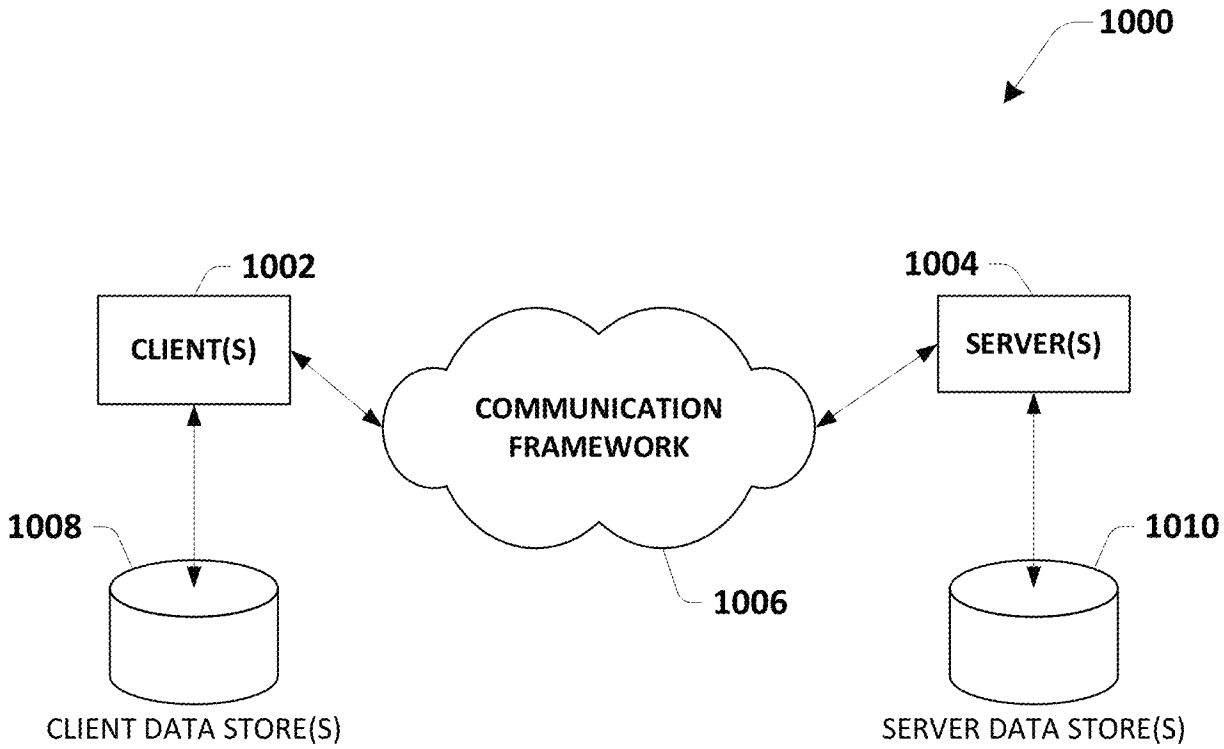
FIG. 10 illustrates a non-limiting networking environment in which one or more embodiments described herein can be implemented.

Referring now to FIG. 10, there is illustrated a schematic block diagram of a computing environment 1000 in accordance with this specification. The system 1000 includes one or more client(s) 1002, (e.g., computers, smart phones, tablets, cameras, PDA's). The client(s) 1002 can be hardware and/or software (e.g., threads, processes, computing devices). The client(s) 1002 can house cookie(s) and/or associated contextual information by employing the specification, for example.

The system 1000 also includes one or more server(s) 1004. The server(s) 1004 can also be hardware or hardware in combination with software (e.g., threads, processes, computing devices). The servers 1004 can house threads to perform transformations of media items by employing aspects of this disclosure, for example. One possible communication between a client 1002 and a server 1004 can be in the form of a data packet adapted to be transmitted between two or more computer processes wherein data packets can include coded analyzed headspaces and/or input. The data packet can include a cookie and/or associated contextual information, for example. The system 1000 includes a communication framework 1006 (e.g., a global communication network such as the Internet) that can be employed to facilitate communications between the client(s) 1002 and the server(s) 1004.

Communications can be facilitated via a wired (including optical fiber) and/or wireless technology. The client(s) 1002 are operatively connected to one or more client data store(s) 1008 that can be employed to store information local to the client(s) 1002 (e.g., cookie(s) and/or associated contextual information). Similarly, the server(s) 1004 are operatively connected to one or more server data store(s) 1010 that can be employed to store information local to the servers 1004.

In one exemplary implementation, a client 1002 can transfer an encoded file, (e.g., encoded media item), to server 1004. Server 1004 can store the file, decode the file, or transmit the file to another client 1002. It is to be appreciated, that a client 1002 can also transfer uncompressed file to a server 1004 and server 1004 can compress the file and/or transform the file in accordance with this disclosure. Likewise, server 1004 can encode information and transmit the information via communication framework 1006 to one or more clients 1002.

The illustrated aspects of the disclosure may also be practiced in distributed computing environments where certain tasks are performed by remote processing devices that are linked through a communications network. In a distributed computing environment, program modules can be located in both local and remote memory storage devices.

The above description includes non-limiting examples of the various embodiments. It is, of course, not possible to describe every conceivable combination of components or methods for purposes of describing the disclosed subject matter, and one skilled in the art may recognize that further combinations and permutations of the various embodiments are possible. The disclosed subject matter is intended to embrace all such alterations, modifications, and variations that fall within the spirit and scope of the appended claims.

With regard to the various functions performed by the above described components, devices, circuits, systems, etc., the terms (including a reference to a "means") used to describe such components are intended to also include, unless otherwise indicated, any structure(s) which performs the specified function of the described component (e.g., a functional equivalent), even if not structurally equivalent to the disclosed structure. In addition, while a particular feature of the disclosed subject matter may have been disclosed with respect to only one of several implementations, such feature may be combined with one or more other features of the other implementations as may be desired and advantageous for any given or particular application.

The terms "exemplary" and/or "demonstrative" as used herein are intended to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent structures and techniques known to one skilled in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

The term "or" as used herein is intended to mean an inclusive "or" rather than an exclusive "or." For example, the phrase "A or B" is intended to include instances of A, B, and both A and B. Additionally, the articles "a" and "an" as used in this application and the appended claims should generally be construed to mean "one or more" unless either otherwise specified or clear from the context to be directed to a singular form.

The term "set" as employed herein excludes the empty set, e.g., the set with no elements therein. Thus, a "set" in the subject disclosure includes one or more elements or entities. Likewise, the term "group" as utilized herein refers to a collection of one or more entities.

The description of illustrated embodiments of the subject disclosure as provided herein, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as one skilled in the art can recognize. In this regard, while the subject matter has been described herein in connection with various embodiments and corresponding drawings, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. An apparatus integral with, or attachable to, a protective headgear, comprising:

a cushioned bendable material integral with, or attachable to, an inside portion of the protective headgear, wherein an ear cup of the inside portion of the protective headgear is able to expand and contract;

an on-ear headset attachable to an inside portion of the protective headgear;

a first magnet within the ear cup of the inside portion of the protective headgear that attaches the on-ear headset to the ear cup;

a second magnet that exerts a force, on the cushioned bendable material, towards an outer casing of the protective headgear to create a recess for the on-ear headset;

a battery receiving portion to position a battery in the ear cup; and a switch to change the polarity of the second magnet.

2. The apparatus of claim 1, wherein the cushioned bendable material of the ear cup comprises memory foam for sound isolation.

3. The apparatus of claim 1, further comprising a microphone integral with, or attachable to, the protective headgear, wherein the microphone captures sound directional input and voice input from sound input received via the microphone.

4. The apparatus of claim 3, wherein the cushioned bendable material of the ear cup comprises at least a portion that is dense paper of at least a threshold density.

5. The apparatus of claim 3, wherein the on-ear headset is coupled to a dynamic range controller that enables setting of at least one of an upper sound level limit or a lower sound level limit for sound output to a user via the on-ear headset, and wherein the dynamic range controller enables adjustment of at least one of the upper sound level limit or the lower sound level limit.

6. The apparatus of claim 3, wherein the microphone employs a trained gaussian mixture model, for sound directional identification and sound classification, that is applied to sound received via the microphone.

7. The apparatus of claim 1, wherein the switch is a knob handle or a slide handle positioned on the outer casing of the protective headgear, and wherein the switch changes the force generated as a result of the change of the polarity of the second magnet.

8. The apparatus of claim 1, wherein the on-ear headset supports Bluetooth functionality enabling connection between the on-ear headset and a pairing user device supporting Bluetooth functionality.

9. The apparatus of claim 1, wherein the on-ear headset employs an active noise control process to reduce low frequency sound received via a microphone input of the on-ear headset.

10. An article of manufacture, comprising:

compressible foam material attachable to an inner portion of a headgear that is wearable on a head, the compressible foam material comprising:

a recess for an on-ear headset, wherein, as the headgear is being positioned on the head, at least a part of the head pushes a headband of the on-ear headset into the recess of the compressible foam material, and wherein the compressible foam material surrounds the on-ear headset to reduce external noise originating in an external environment outside of the on-ear headset;

a first magnet within an ear cup of the inside portion of the headgear that, as the headgear is being positioned on the head, attaches the on-ear headset to the ear cup, wherein a magnetization exhibited by the first magnet reduces a gap between the compressible foam material and the on-ear headset relative to the magnetization being absent; and a second magnet that, as a result of at least the part of the head pushing the on-ear headset into the recess of the compressible foam material, changes a polarity from a first polarity to a second polarity, wherein, when the polarity of the second magnet is the second polarity, the second magnet operates to pull the compressible foam material towards an outer casing of the headgear, and wherein, when the polarity of the second magnet is the first polarity, the second magnet operates to push the compressible foam material towards the inner portion of the headgear.

11. The article of manufacture of claim 10, further comprising, a switch to change the polarity of the second magnet, wherein the switch adjusts a force of the second magnet by adjusting a distance between the first magnet and the second magnet.

12. The article of manufacture of claim 11, wherein the switch is a knob handle or a slide handle positioned on an outer casing of the headgear.

13. The article of manufacture of claim 10, further comprising a microphone array integral with, or attachable to, the protective headgear, wherein the microphone array is omni-directional, and wherein the microphone array obtains sound directional input to detect a hazard.

14. The article of manufacture of claim 13, wherein the microphone array employs a gaussian mixture model to identify and classify the hazard.

15. The article of manufacture of claim 13, wherein the microphone array obtains voice input for hands-free communication.

16. The article of manufacture of claim 10, further comprising a battery located in the ear cup to provide power to the headgear.

17. A method, comprising:

as part of an on-ear headset being inserted into an inside portion of a protective headgear comprising a cushion bendable material, positioning at least one first magnet to attach the on-ear headset to the protective headgear, wherein the at least one first magnet reduces a gap between the cushion bendable material and the on-ear headset, and wherein the on-ear headset being inserted into the inside portion causes an ear cup portion of the cushion bendable material to be urged towards an outer casing of the protective headgear;

urging, by application of a force via at least one second magnet, the ear cup portion of the cushion bendable material towards the outer casing of the protective headgear, wherein the at least one second magnet is energized by a battery to change polarity; and adjusting the force of the at least one second magnet by a switch adapted to the outer casing of the protective head gear, wherein the switch adjusts the distance between the at least one first magnet and the at least one second magnet.

18. The method of claim 17, further comprising:

changing the polarity of the at least one second magnet, wherein the application of the force via the at least one second magnet is powered by a battery coupled to the switch and positioned inside the ear cup portion.

19. The method of claim 17, further comprising:

urging, by application of another force via at least one second magnet, the at least one second magnet to urge the ear cup portion of the cushion bendable material towards the inner portion of the protective gear.

20. The method of claim 17, further comprising:

employing a microphone array for detection of a hazard, comprising:

identifying the hazard based on an acoustic frequency of sound input received via the microphone array, and based on the sound input and the acoustic frequency, classifying the hazard as a type of hazard from a group of types of hazards.

* * * * *